US005754920A

United States Patent [19]

Tanaka et al.

[11] Patent Number: 5,754,920

[45] Date of Patent: May 19, 1998

[54] IMAGE FORMING APPARATUS AND IMAGE FORMING METHOD

[75] Inventors: Masaki Tanaka, Toyohashi; Kentaro Katori, Toyokawa; Atsushi Kawai, Aichi-Ken; Hironobu Nakata, Toyokawa, all of Japan

[73] Assignee: Minolta Co., Ltd., Osaka, Japan

[21] Appl. No.: 806,680

[22] Filed: Feb. 26, 1997

[30] Foreign Application Priority Data

Feb. 28, 1996 [JP] Japan ..... 8-041027

[51] Int. Cl.[6] ..... G03G 15/06; G03G 21/00

[52] U.S. Cl. ..... 399/49; 399/53

[58] Field of Search ..... 399/49, 50, 51, 399/53, 55, 38

[56] References Cited

U.S. PATENT DOCUMENTS 5,099,279 3/1992 Shimizu ..... 399/49

5,266,997 11/1993 Nakane et al. ..... 399/49

5,579,090 11/1996 Sasanuma et al. ..... 399/49

5,585,927 12/1996 Fukui et al. ..... 358/298

*Primary Examiner*—R. L. Moses

*Attorney, Agent, or Firm*—Burns, Doane, Swecker & Mathis, LLP

[57] ABSTRACT

The present invention relates to an image forming apparatus for copiers, printers and the like. In the image forming apparatus, a standard pattern image, the density of which is detected by a sensor for controlling conditions of image forming operations, is formed on a photosensitive member. Density values are sampled at a plurality of sampling points on a standard pattern image by operating the sensor with a timing at which said sensor confronts said standard pattern image, and are mutually compared with each other. If the comparison result indicates that the timing of the sampling operation lags the standard pattern image, the sampling timing is corrected by eliminating the timing lag. The sampling operation of a subsequent sampling cycle is thereby conducted based on a corrected timing.

12 Claims, 12 Drawing Sheets

Control Signal
T-base Signal
40msec
Standard Pattern
Forming Signal
100msec
AIDC Sensor
Control Signal Output of
AIDC
Sensor
250msec
(V)
4
3
2
1
0
A1
A2
A3
A4
A5
A6
A7
A8
A9
A10
0.05(V)
Time(t)
250msec
100msec Control Signal
T-base Signal
40msec
Standard Pattern Forming Signal
100msec
AIDC Sensor Control Signal Output of AIDC Sensor
250msec
(V)
4
3
2
1
0
A1
A2
A3
A4
A5
A6
A7
A8
A9
A10
0.05(V)
Time (t)
250msec
75msec

IMAGE FORMING APPARATUS AND IMAGE FORMING METHOD

BACKGROUND OF THE INVENTION

1. Field of the Invention

The present invention relates to An image forming method and image forming apparatus for copiers, printers and the like.

2. Description of the Related Art

In conventional image forming apparatuses for copiers, printers and the like, it is known that image density control to form an image on a paper sheet is executed before an image forming operation using various types of sensors provided within the apparatus. For example, a toner image of a standard pattern solid image is formed on a part of the surface of a photosensitive member within the image forming apparatus, and the amount of adhered toner of said standard pattern (i.e., image density) is detected by a sensor, and various image forming conditions such as the charge potential of the photosensitive member, developing bias potential, and amount of exposure are adjusted based on the aforesaid detected amount of adhered toner so as to control the density of the image formed on the copy sheet at a desired level. To execute the image density control with excellent precision it is necessary to accurately detect the amount of adhered toner of the standard pattern. In order to obtain sensor output which accurately expresses the amount of adhered toner of the standard pattern, it has been proposed that the image forming conditions be controlled based on an average value of sensor output at a plurality of locations on the standard pattern, or based on an average value among sensor output at said plurality of locations which eliminates the maximum and minimum values.

In such image forming apparatuses, the characteristic value of the object of detected cannot be detected with precision when the detection timing of the sensor detecting a standard pattern formed on the surface of a photosensitive member lags due to disturbances caused by durability and the environment and the like, or when the are large fluctuations of the average values due to impaired detected caused by soiling and the like at the plurality of locations detected.

SUMMARY OF THE INVENTION

In view of the previously presented information, an object of the present invention is to provide an improved image forming apparatus and image forming method.

The objects of the present invention are achieved by providing an image forming apparatus and image forming method which control image forming conditions based on accurate detection of the characteristic value of a detection object.

These objects of the present invention are achieved by providing an image forming apparatus which provides a sensor on the movement path of a movable photosensitive member to detect characteristics value of the photosensitive member, said image forming apparatus comprising: a sampling means for sampling density values at a plurality of sampling points on a standard pattern image formed on said photosensitive member by operating said sensor with a timing at which said sensor confronts said standard pattern image; a comparison means for mutually comparing a plurality of sampling values obtained by the sampling of said sampling means; a determination means for determining whether or not the timing of said sampling means lags the standard pattern image based on the comparison result of said comparison means; a correction means for correcting the timing by eliminating the timing lag when a timing lag is determined by said determination means, such that sampling of a subsequent sampling cycle is thereby conducted based on a corrected timing; and a controller which controls an image forming operation in accordance with the sampling values.

These objects of the present invention are also achieved by providing an image forming method used in an image forming apparatus which provides a sensor on the movement path of a movable photosensitive member to detect characteristics value of the photosensitive member, said image forming method comprising steps of: sampling density values at a plurality of sampling points on a standard pattern image formed on said photosensitive member by operating said sensor with a timing at which said sensor confronts said standard pattern image; mutually comparing a plurality of sampling values obtained in said sampling step; determining whether or not the timing of said sampling means lags the standard pattern image based on the comparison result of said comparing step; correcting the timing by eliminating the timing lag when a timing lag is determined in said determining step, such that sampling of a subsequent sampling cycle is thereby conducted based on a corrected timing; and controlling an image forming operation in accordance with the sampling values.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

This application is based on Patent Application No. 8-41027 in Japan, the content of which is incorporated hereunto by reference.

The present invention is described hereinafter in terms of a digital color copier with reference to the accompanying drawings.

(1) Digital Color Copier Construction

Figure 1:
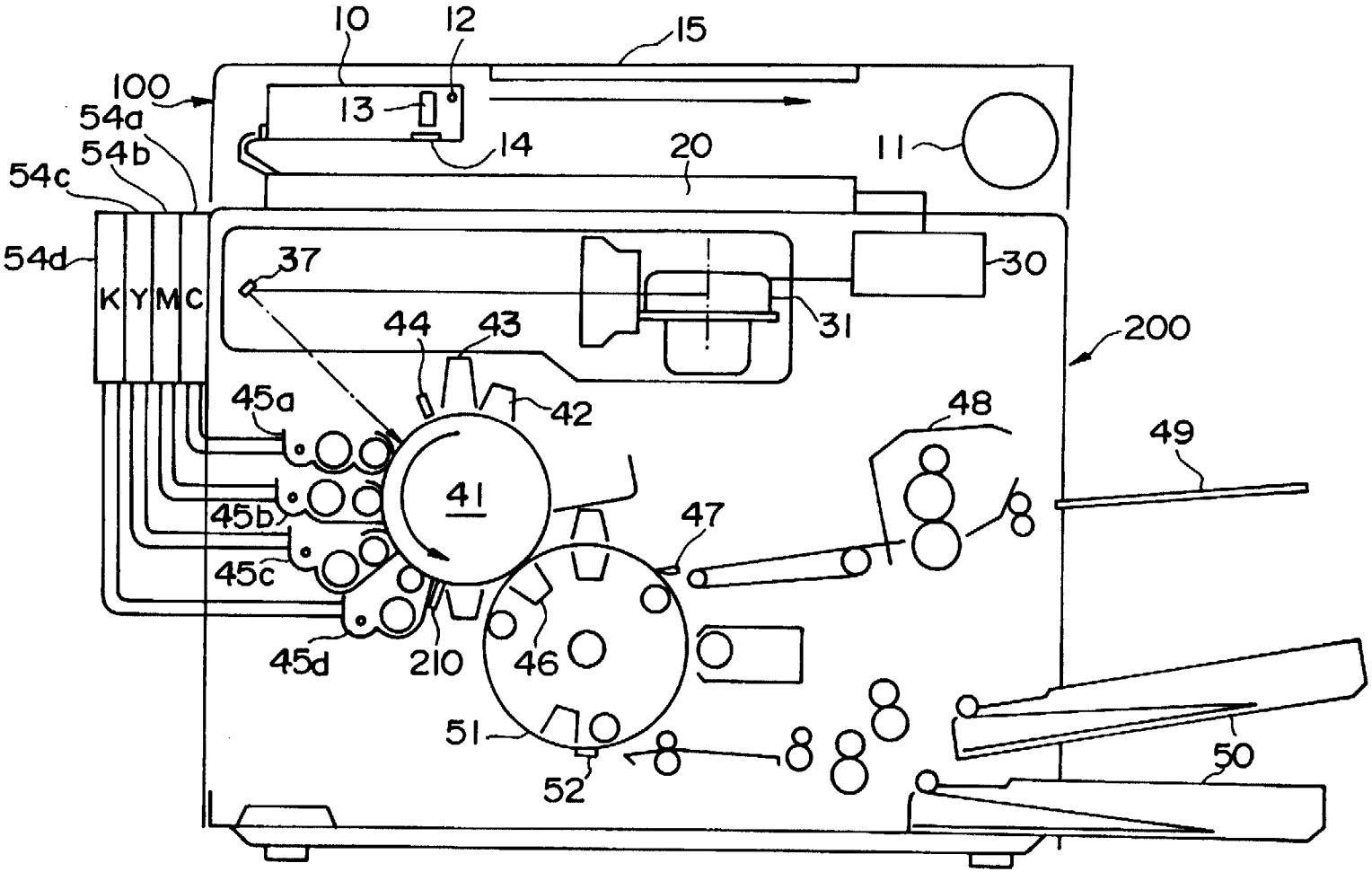
FIG. 1 is a brief section view of a digital color copier.

FIG. 1 is a cross section view briefly showing the construction of a digital color copier. The digital color copier can be broadly divided into an image reader unit 100 for reading document images, and printer unit 200 for reproducing the image read by said image reader unit 100.

In image reader unit 100, scanner 10 is provided with an exposure lamp 12 to illuminate a document, rod lens array 13 to condense the light reflected from the document, and a sealed type charge-coupled device (CCD) color image sensor 14 to convert the condensed light to electrical signals. Scanner 10 is driven by a motor 11 to move in the arrow direction (subscan direction) when scanning a document, and scans a document placed on platen 15 four times to make one copy. The image of a document surface illuminated by exposure lamp 12 is converted to electrical signals by image sensor 14. Multi-level electrical signals of the three colors red (R), green (G), blue (B) obtained by image sensor 14 by the first scan are converted to yellow (Y) image data having a value corresponding to the document image density of 8-bits per pixel via image signal processing unit 20, which are stored in synchronization buffer memory 20. Then, electrical signals obtained by the second scan are converted to magenta (M) image data, electrical signals obtained by the third scan are converted to cyan (C) image data, and electrical signals obtained by the fourth scan are converted to black (K) image data, and stored in synchronization buffer memory 30.

Figure 2:
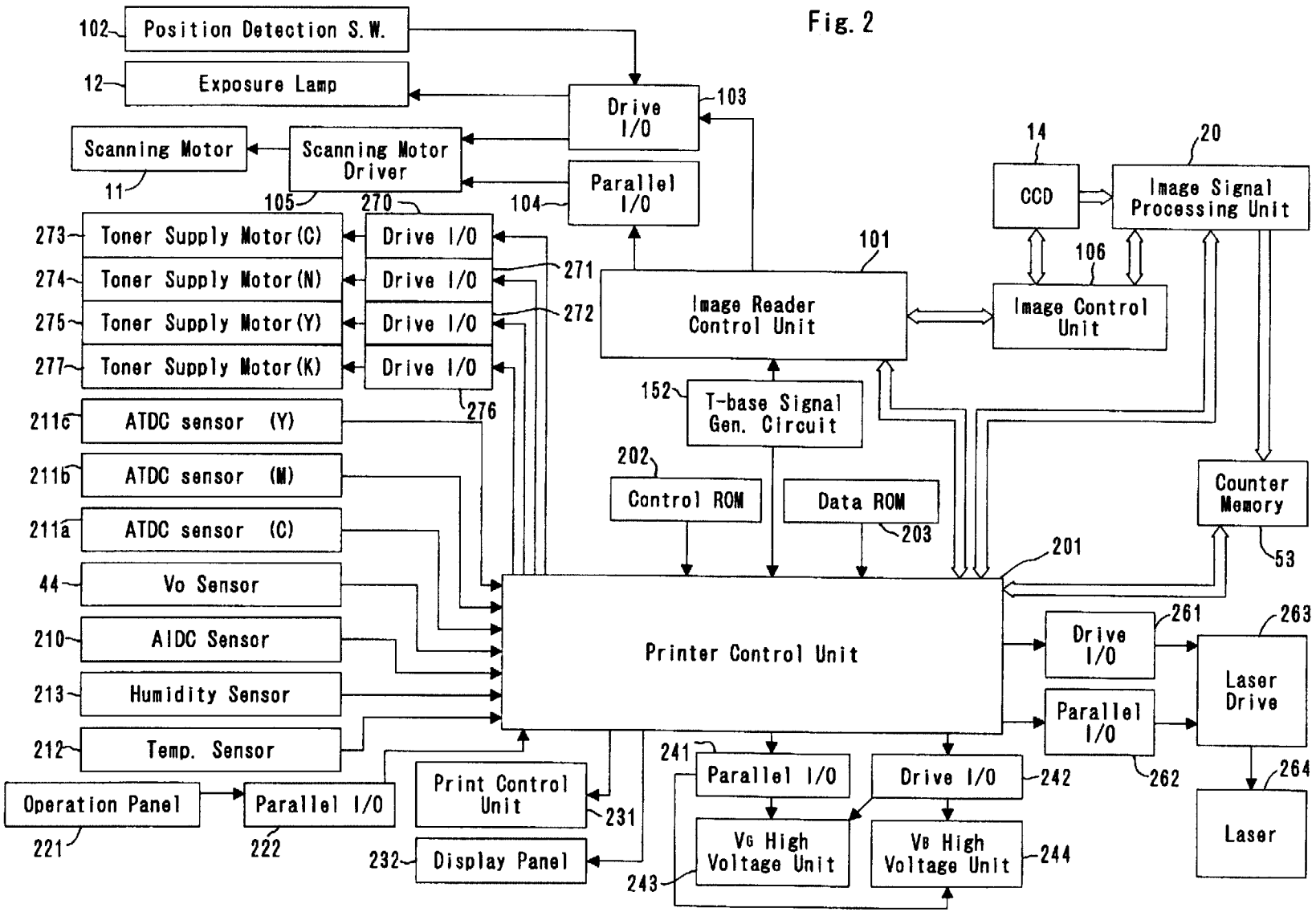
FIG. 2 is a block diagram of the control circuit of the digital color copier.

In printer unit 200, after the input image data are subjected to halftone correction in accordance with the halftone characteristics of the photosensitive member, printhead 31 converts the corrected image data via digital-to-analog (D/A) conversion and generates laser diode drive signals which are used to modulate the semiconductor laser 264 (refer to FIG. 2).

The laser beam emitted from printhead 31 in accordance with the image data is directed by a reflective mirror 37 to expose the surface of a rotatably driven photosensitive drum 41. The surface of photosensitive drum 41 is irradiated by eraser lamp 42 and uniformly charged by charger 43 prior to the exposure of each color print. When the laser exposure occurs in this state, an electrostatic latent image corresponding to the document image is formed on the surface of photosensitive drum 41. Only one developing device among the cyan, magenta, yellow, and black toner developing devices **45*a* through 45*d* is selected to develop the latent image formed on the surface of photosensitive drum 41. The developed toner image is transferred to a copy sheet wrapped around the surface of transfer drum 51 by a transfer charger 46. Photosensitive drum 41 and transfer drum 51 are rotated synchronously, and the Y, M, C, and K image data are generated by repeated scanning operations of scanner 10 as previously described. The generated Y, M, C, and K image data are printed vias the process described above, and the toner images of the four colors are overlaid on the copy sheet so as to produce a full color image. Thereafter, the copy sheet is separated from the transfer drum 51 via the operation of a separation member 47, and transported to fixing device 48 where the toner images are fixed to said copy sheet which is then ejected to discharge tray 49. Furthermore, the copy sheet is fed from paper cassette 50, and the leading edge of said sheet is chocked to the surface of transfer drum 51 via a chocking mechanism 52** so as to prevent positional dislocation during the transfer process.

An automatic image density control (AIDC) sensor 210 is disposed between developing device **45*d* and transfer charger 46 so as to confront photosensitive drum 41. The AIDC sensor 210 comprises a photoemitter element and a photoreceptor element. The light emitted by the photoemitter element impinges the photosensitive drum, and the light reflected from the toner image formed on the surface of the photosensitive drum is received by the photoreceptor element, which outputs an electrical signal corresponding to the amount of received light. Thus, the AIDC sensor 210 outputs signals having a voltage level corresponding to the intensity of the reflected light which is proportional to the amount of adhered toner, i.e., the density of the toner image developed by developing devices 45*a* through 45*d***. The amount of adhered toner of a developed standard pattern formed by a predetermined amount of light exposure at predetermined locations on a photosensitive member can be determined.

When developing is accomplished in the aforesaid printing process, the toner within the developing device becomes depleted, and toner concentration is reduced. The depleted toner is replenished from hoppers **54*a* through 54*d***.

FIG. 2 shows the control block of the digital color copier. image reader unit 100 is controlled by the image reader control unit 101. Image reader control unit 101 controls the exposure lamp 12 via drive input/output port 103 by means of positions signals output from position detection switch 102 which show the position of the document placed on platen 15, and controls the scanning motor driver 105 via drive input/output port 103 and parallel input/output port 104. Scanning motor 11 is driven by scanning motor driver 105.

On the other hand, image reader control unit 101 is connected to image control unit 106 via a data bus. Image control unit 106 is connected to CCD color image sensor 14 and image signal processing unit 20 via a data bus. Image signals output from the CCD color image sensor 14 are input to image signal processing unit 20.

In printer unit 200, the printer control unit 201 which controls the general printing operation is connected a control read only memory (ROM) 202 which stores control programs and is also connected to a data ROM 203 which stores various types of data. Printer control unit 201 controls the printing operation by means of the data stored in the aforesaid ROM.

Analog signals from various sensors including $V_0$ sensor 44 for detecting the surface potential $V_0$ of photosensitive drum 41, AIDC sensor 210 for optically detecting the amount of adhered toner (mg/cm$^2$) of a standard pattern adhered to the surface of photosensitive drum 41, ATDC sensors **211*a* through 211*c* for detecting the toner concentration within developing devices 45*a* through 45*d*, temperature sensor 212 and humidity sensor 213 are input to printer control unit 201. A T-base signal generator 152 outputs timing reference signals (hereinafter referred to as "T-base signals") for each rotation of the transfer drum 51 to image reader control unit 101 and printer control unit 201**.

Printer control unit 201 controls print control unit 231 and display panel 232 in accordance with the content of control ROM 202 via data from the various sensors 44, and 210 through 213, control panel 221, and data ROM 203, and executes automatic controls based on AIDC sensor 210, or controls $V_G$ high voltage unit 243 which generates a grid potential $V_G$ for charger 43, and $V_B$ high voltage unit 244 which generates a developing bias potential $V_B$ for developing devices 45*a* through 45*d* to accomplish manual density control via input to operation panel 221 through parallel input/output port 241 and drive input/output port 242.

Printer control unit 201 is connected to image signal processing unit 20 of image reader unit 100 via an image data bus, and refers to the contents of data ROM 203 storing gamma correction tables based on the image density signals received via the image data bus, and controls semiconductor laser driver 263 via driver input/output port 261 and parallel input/output port 262 based on said reference result. The laser beam emission of semiconductor laser 264 is driven by semiconductor laser driver 263. Halftone reproduction is accomplished by modulating the intensity of the laser beam emission of semiconductor laser 264.

The printer control unit 201 is connected to the image signal processing unit 20 of image reader unit 100 via a counter memory 53 and a separate image data bus. The counter memory 53 counts and stores each level of the 8-bit data from image signal processing unit 20. The counter memory 53 stores data of each single scan of scanner 10, and printer control unit 201 reads the data of a single scan in accordance with scanner operation signals transmitted from image reader control unit 101. Counter memory 53 cancels the data at the moment printer control unit 201 finishes reading the data of one scan.

(2) Image Signal Processing

Figure 3:
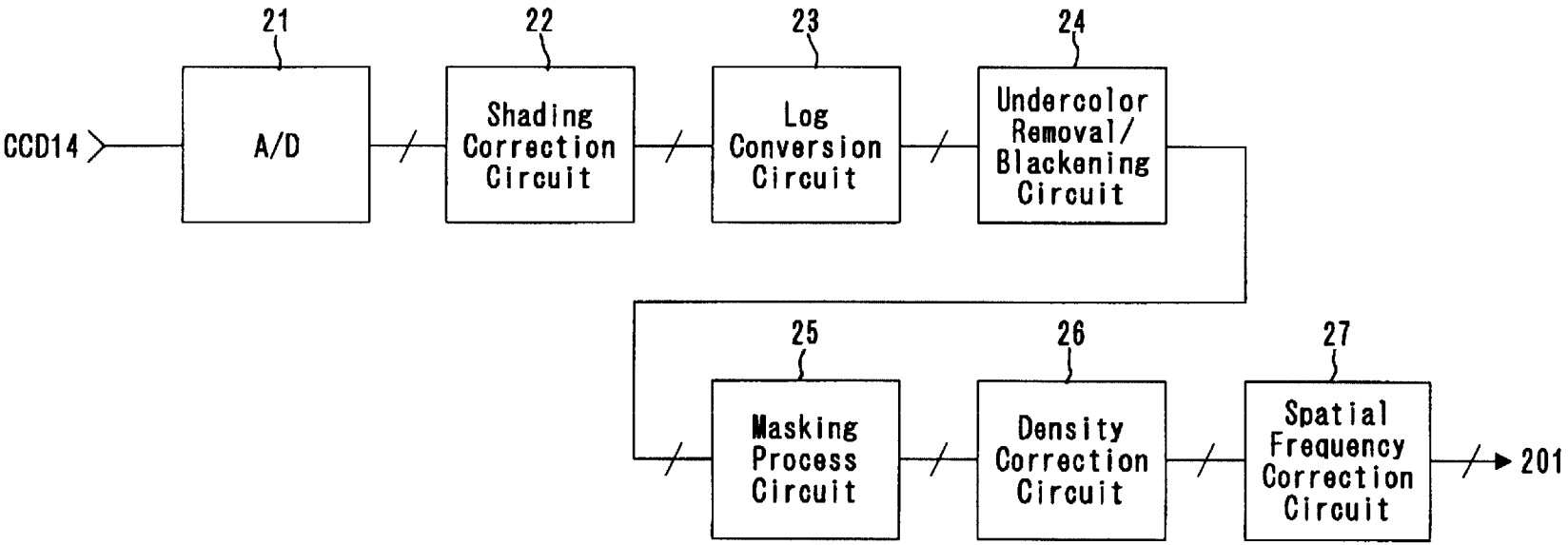
FIG. 3 is a block diagram of the flow of the image signal process in the image signal processing unit.

FIG. 3 illustrates the flow of the image signal process from CCD color image sensor 15 to printer control unit 201 via image signal processing unit 20. Signal processing comprising the processing of output signals from the CCD color image sensor 14 and outputting image data is described hereinafter with reference to the drawing.

In image signal processing unit 20, image signals subjected to photoelectric conversion by CCD color image sensor 14 are converted to R, G, B multi-level digital image data by A/D converter 21. These multi-level image data are subjected to shading correction by shading correction circuit 22. The image data corrected for shading are data based on the reflectivity of the document, and are subjected to logarithmic conversion (log conversion) in log conversion circuit 23 to obtain density data. Undercolor remova l/blackening circuit 24 removes excess black coloration and generates true black data K from the R, G, B data. Masking process circuit 25 converts the three color R, G, B data of each scan to the three color cyan (C), magenta (M), yellow (Y) data. A density correction process is executed by density correction circuit 26 to multiply the converted C, M, Y data by predetermined coefficients, and a spatial frequency correction process is executed by spatial frequency correction circuit 27, after which the data are output to printer control unit 201.

Figure 4:
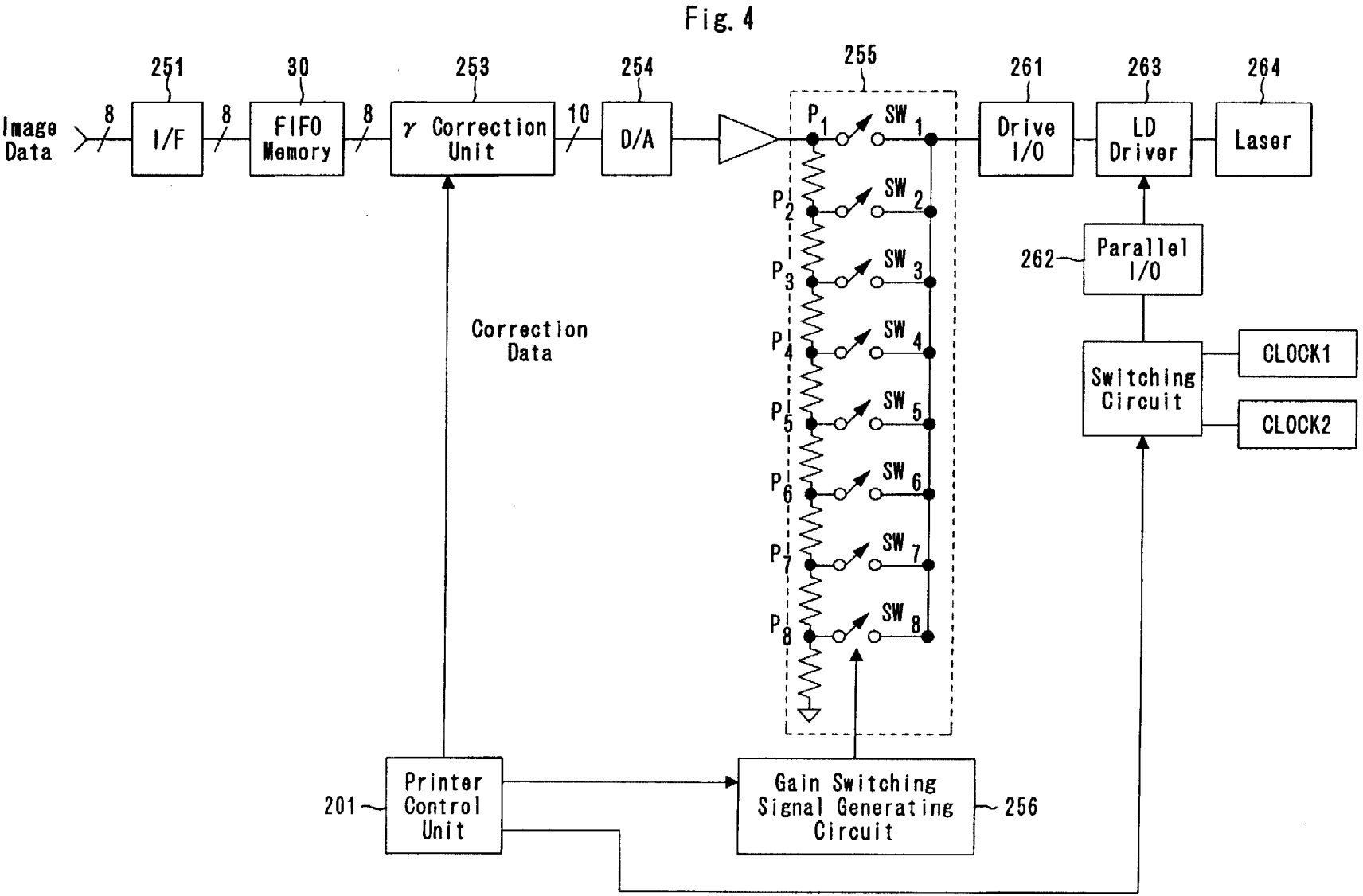
FIG. 4 is a block diagram of the flow of the image data process in the printer control unit.

FIG. 4 is a block diagram showing the image data process block in printer control unit 201. Image data (8-bit) input from image signal processing unit 20 are stored in first-in/first-out memory 30 (hereinafter referred to as "FIFO memory 30") via interface 251. FIFO memory 30 is a line buffer memory capable of storing image data of an image of a predetermined number of lines in the main scan direction, and is provided to accommodate the differences in operation block frequencies of image reader unit 100 and printer unit 200. The data stored in FIFO memory 30 are next input to gamma correction unit 253. The gamma correction data of data ROM 203 are transmitted to gamma correction unit 253 by printer controller 201, and gamma correction unit 253 corrects the input data and transmits the output level to D/A converter 254. The analog voltage converted from the output level of D/A converter 254 is amplified to switch the switches SW1 through SW8 via gain switching signal generating circuit 256 in accordance with a set gain value output from printer control unit 201 in gain switching unit 255, and thereafter the said amplified analog voltage is transmitted to semiconductor laser driver 263 via driver input/output port 261, and semiconductor laser 264 emits a laser beam having an intensity corresponding to the value of said analog voltage. Printer control unit 201 transmits clock signals to semiconductor laser driver 263 via parallel input/output port 262.

(3) Automatic Image Density Control

The density of an image formed on paper is controlled by the relationship between the grid potential $V_G$ of charger 4 which uniformly charges the surface of photosensitive drum 41, and the developing bias potential $V_B$ applied to the surface of the developing sleeves of toner developing devices 45*a* through 45*d*.

Figure 5:
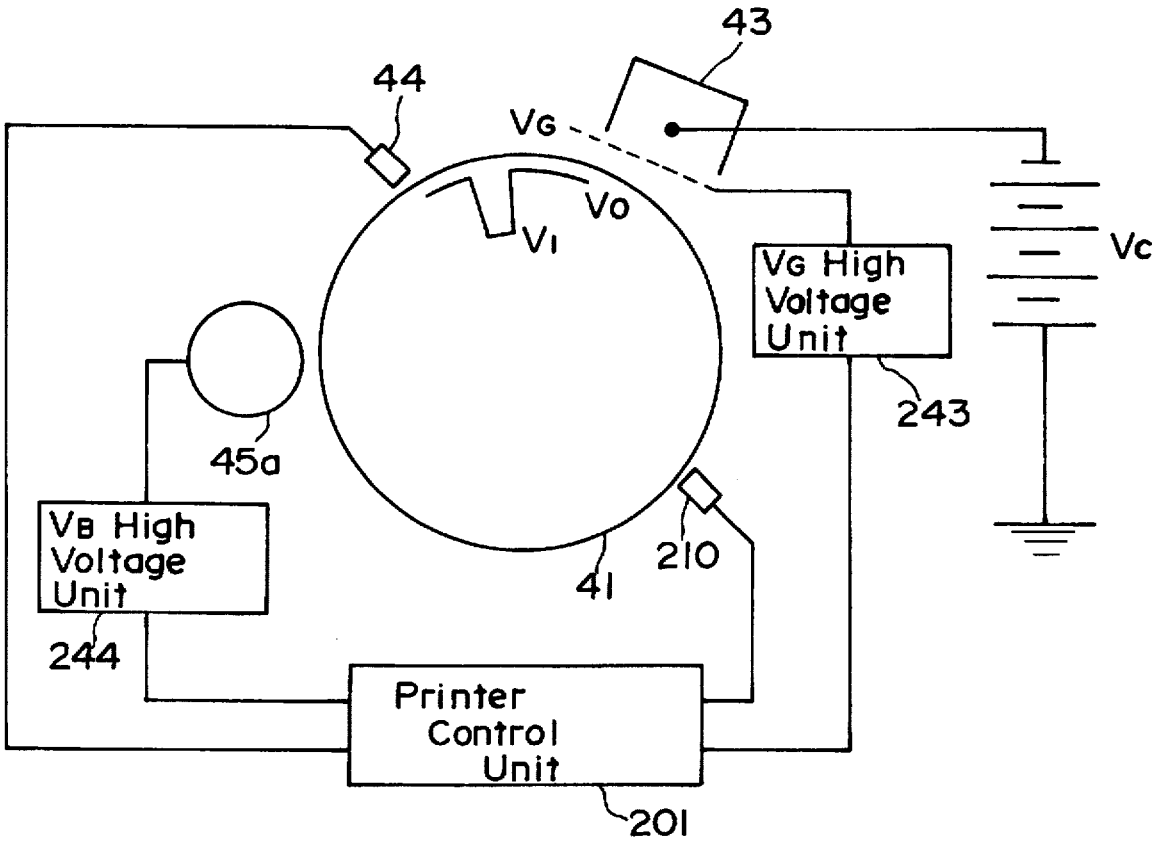
FIG. 5 shows the arrangement of the chargers and developing device around the photosensitive drum.

FIG. 5 shows the arrangement of charger 43 and a developing device (e.g., developing device 45*a*) around the photosensitive drum 41. Charger 43 having a discharge potential VC is disposed so as to confront photosensitive drum 41. A negative grid potential $V_G$ is applied to the grid of charger 43 by grid potential generator 243. The relationship between the grid potential $V_G$ and the surface potential $V_0$ of the photosensitive drum is such that $V_0$=.$V_G$, and the surface potential $V_0$ of the photosensitive drum 41 is controlled by $V_0$ sensor 44. The surface potential $V_0$ is detected by a surface potentiometer $V_0$ sensor 44.

Prior to laser exposure, the surface of photosensitive drum 41 is charged to a negative surface potential $V_0$ by charger 43, and a low potential negative bias voltage $V_B$ is applied to the roller of developing device 45*a* by developing bias generator 244 (where the relationship $|V_B|<|V_0|$ is satisfied). That is, the surface potential of the developing sleeve is designated $V_B$.

When the potential is reduced at the position on the surface of photosensitive drum 41 exposed by the laser beam emitted by semiconductor laser 264 based on the image data such that the decay potential $V_i$ of the electrostatic latent image reduced from surface potential $V_0$ becomes lower than the develop bias $V_B$, the toner charged to a negative polarity carried on the surface of the developing sleeve of developing device 45*a* is adhered to the surface of photosensitive drum 41. The difference between $V_0$ and $V_B$ should be neither excessively large or excessively small. The amount of adhered toner may be such that developing voltage $\Delta V=|V_B-V_i|$. On the other hand, the decay potential $V_i$ may change in conjunction with the change in surface potential $V_0$ while the amount of exposure light remains constant. If the difference between $V_0$ and $V_B$ is maintained within a particular range, e.g., if the difference remains fairly constant, the amount if adhered toner and consequently the toner density can be controlled by changing the difference between $V_B$ and $V_i$ as the surface potential $V_0$ and the developing bias $V_B$ change.

The amount of adhered toner (mg/cm$^2$) of a standard pattern image formed by a predetermined optical exposure can be determined from the output (V) of the AIDC sensor 210. The timing for forming a standard pattern image on the surface of photosensitive drum 41 and detecting the amount of adhered toner of a standard pattern image via AIDC sensor 210 is stored beforehand in memory in a register of printer control unit 201, and can be operated repeatedly after a T-base signal is received from T-base signal generating circuit 152. A standard pattern is formed comprising a solid image used as a standard for density control of photosensitive drum 41. Printer control unit 201 detects the reflected light of the standard pattern via AIDC sensor 210 provided adjacent to photosensitive drum 41, and determines the amount of adhered toner on the surface of photosensitive drum 41. Automatic density control maintains a constant amount of adhered toner at a maximum density level by changing $V_G$ and $V_B$ in conjunction with the detected amount of adhered toner.

(4) Auto-correction of Sensor Output Timing

Although a maximum image density is controlled so as to remain constant by controlling $V_G$ and $V_B$ as previously described in the present copier, the AIDC sensor 210 and $V_O$ sensor 44 must detect the reference pattern and surface potential on the surface of photosensitive drum 41 with high precision. Sensor detection precision can be improved by executing the controls described below.

Figure 6A:
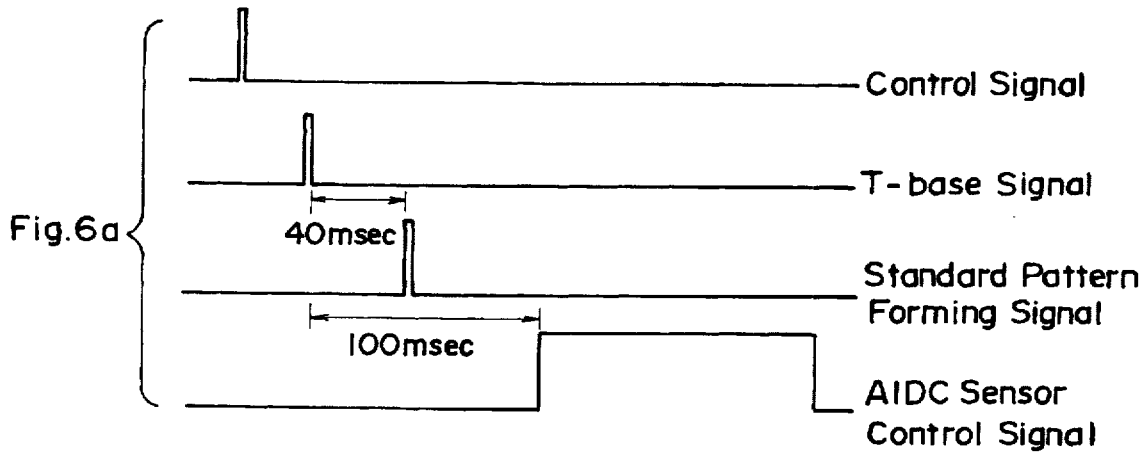
FIG. 6*a* illustrates the detection timing of the standard pattern via an AIDC sensor.
Figure 6B:
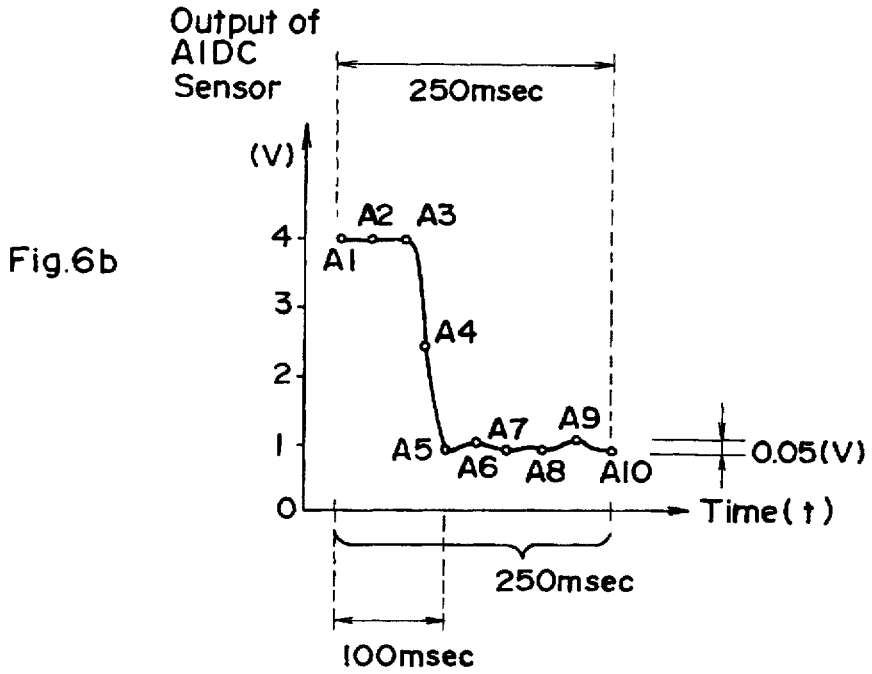
FIG. 6*b* illustrates the output of the AIDC sensor by said timing.
Figure 7:
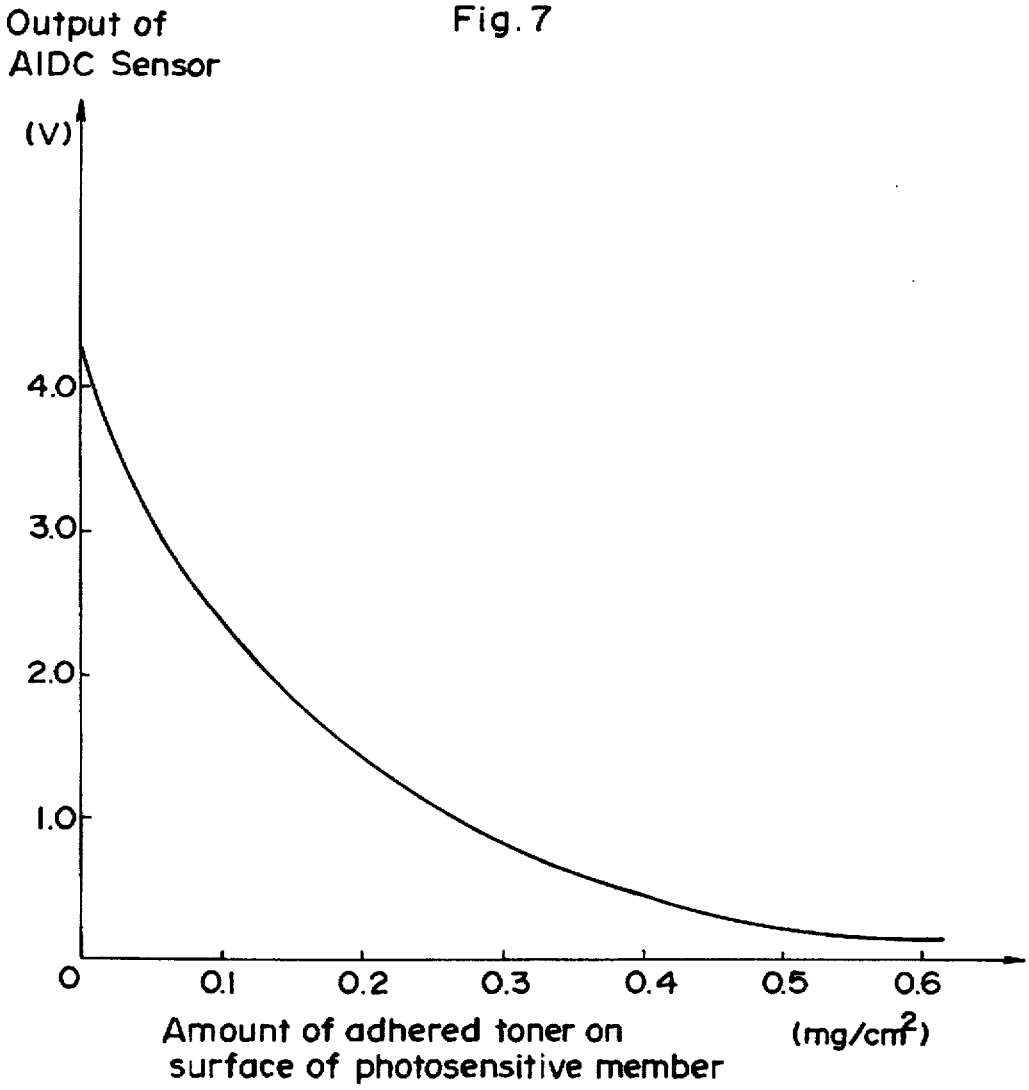
FIG. 7 is a graph showing the relationship between the amount of adhered toner on the surface of the photosensitive member and the output of the AIDC sensor.

Sensor detection timing correction is described below with reference to FIGS. 6 and 7. As shown in FIG. 6*a*, printer control unit 201 outputs control signals (pulse signals) to execute automatic image density control when the main switch is turned ON or a copy operation ends. After the aforesaid control signal is output, printer control unit 201 detects the T-base signal generated for each rotation of transfer drum 51. Printer control unit 201 executes an operation sequence to form a standard pattern comprising a solid image on the surface of photosensitive drum 41 at 40 msec after the T-base signal is detected. Furthermore, printer control unit 201 starts detecting the amount of adhered toner of a standard pattern by operating the AIDC sensor 210 at 100 msec after the T-base signal is detected. In the present embodiment, the length of the standard pattern in the sub-scan direction (direction of rotation of the photosensitive drum) is 30 mm, and the rotational speed of the photosensitive drum is 120 mm/sec. Accordingly, the time required for detection is 250 msec, and printer control unit 201 stops the operation of AIDC sensor 210 after 250 msec have elapsed following the start of the detection of adhered toner of the standard pattern. Since the standard pattern is a solid image, the output (V) of AIDC sensor 210 is a constant value regardless of the location when the standard pattern is accurately detected. The graph shown in FIG. 6*b* shows AIDC sensor output (V) when the operation timing of AIDC sensor 210 is increased and locations outside the standard pattern are detected. The amount of adhered toner of the standard pattern is determined based on the average value of output of AIDC sensor 210. In the case of FIG. 6, a value higher than the actual output is designated output (V) of AIDC sensor 210. FIG. 7 is a graph showing the relationship between the amount of adhered toner (mg/cm$^2$) on the surface of photosensitive drum 41 and the output (V) of AIDC sensor corresponding to said amount of adhered toner. As can be understood from this graph, if the output (V) of AIDC sensor 210 increases, the amount of adhered toner is recognized as less than the actual amount. When the image density is controlled based on the amount of adhered toner, density control precision is reduced.

To counteract this reduction in precision, the printer control unit 210 of the present embodiment checks to determine whether or not the AIDC sensor 210 is accurately detecting the standard pattern before specifying the amount of adhered toner of the standard pattern. When the AIDC sensor 210 cannot accurately detect the standard pattern because the standard pattern is a solid image, the sensor output is a certain stable value. As shown in FIG. 7, the output (V) of AIDC sensor 210 becomes a small value inversely proportional to the amount of adhered toner (mg/cm$^2$). Based on this characteristics, it is possible to determined that detection has started before the standard pattern arrives at AIDC sensor 210 when the detected values at sampling points becomes stable after a significant reduction in value. From the next cycle, the operation timing of the AIDC sensor 210 is delayed by the time necessary for the previously detection value to stabilize. On the other hand, when the initial detection value is stable and the detection value markedly increases near the end of the operation of AIDC sensor 210, the operation timing of AIDC sensor 210 is hastened only by the time from the start of the marked increase in the output value of the previous detection until the end of the operation of AIDC sensor 210.

Figure 8A:
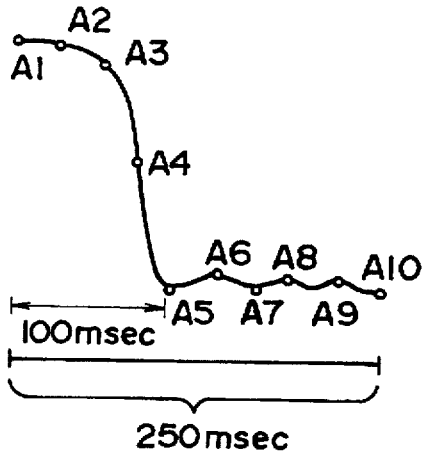
FIG. 8*a* shows the output of the AIDC sensor before timing correction at the beginning of detection by the AIDC sensor.
Figure 8B:
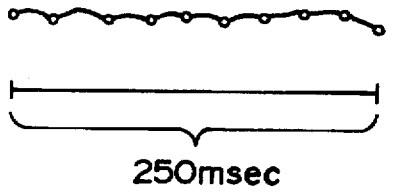
FIG. 8*b* shows the output of the AIDC sensor after timing correction is accomplished.

Specific examples of given below. Printer control unit 210 checks whether or not AIDC sensor 210 accurately detects the standard pattern prior to specifying the amount of adhered toner of the standard pattern. The standard pattern is a solid image having a particular density. Accordingly, when the AIDC sensor can only accurately detect the standard pattern, the detection value can be expected to not depart from within a particular range. The amount of change in the detection value from a first sampling point $A_1$ to the detection value at other sampling points, i.e., $|A_1-A_2|$, $|A_1-A_3|$, . . . $|A_1-A_{10}|$ (the detection time is 250 msec, time of one detection is 25 msec, and the total number of detection points is 10) are determined, and the amount of change in the detection value is compared to a previously determined first reference value. When only the solid image standard pattern is detected, an unobtainable value is set as the first reference value. In the present embodiment, the first reference value is set at 0.5 (V). When the amount of change at any sampling point exceeds the first reference value, it is determined that the standard pattern has not been accurately detected. If the amount of change in the detection values among the detection values at ten points does not exceed the first reference value 0.5 (V), the operation timing of the AIDC sensor is not corrected for the next cycle. Although this first reference value is set beforehand in AIDC sensor 210, it may be changed using operation panel 221. Then, points are detected at which the absolute value of the difference between detection values at adjacent points is less than a second reference value. This second reference value is determined in consideration of output dispersion of the AIDC sensor when a solid image is detected. In the present embodiment, this second reference value is set at 0.05 (V). In the example of FIG. 6*b*, such a point is sampling point $A_6$ at which the change in detection value exceeds 0.5 (V) and the dispersion in detection values is within 0.05 (V). Thus, it can be determined that the AIDC sensor 210 has not detected the standard pattern up to sampling point $A_5$. Furthermore, since the difference between the reference value is a positive value, it can be determined that the operation timing of the AIDC sensor 210 is fast by the time up to the sampling point $A_5$, i.e., 100 msec. Therefore, it can be understood that the operation timing of the AIDC sensor 210 for the next detection is delayed by only 100 msec, i.e., the AIDC sensor 210 is operated for 250 msec after 200 msec has elapsed from the detection of the T-base signal. These data are transmitted to memory in a register of printer control unit 201, and the ON timing of AIDC sensor 210 is corrected. Thus, AIDC sensor 210 can accurately detect the standard pattern. FIG. 8*a* is a graph showing the output of the AIDC sensor before the operation timing is corrected, and FIG. 8b is a graph showing the output of the AIDC sensor after the timing is corrected.

It is possible for the AIDC sensor 210 to detect the standard pattern with excellent precision by means of the previously described controls. Furthermore, image density control can be executed with excellent precision using similar controls for the detection of surface potential $V_0$ of photosensitive drum 41 via $V_0$ sensor 44. the first reference value (0.5 V) and the second reference value (0.05 V) are examples of the present embodiment, and the setting of the reference values is not limited. The reference used to determine the change in detection values is not limited to sampling point $A_1$ of FIG. 6, inasmuch as points $A_1$ through $A_{10}$ may be used for such purpose.

Figure 9A:
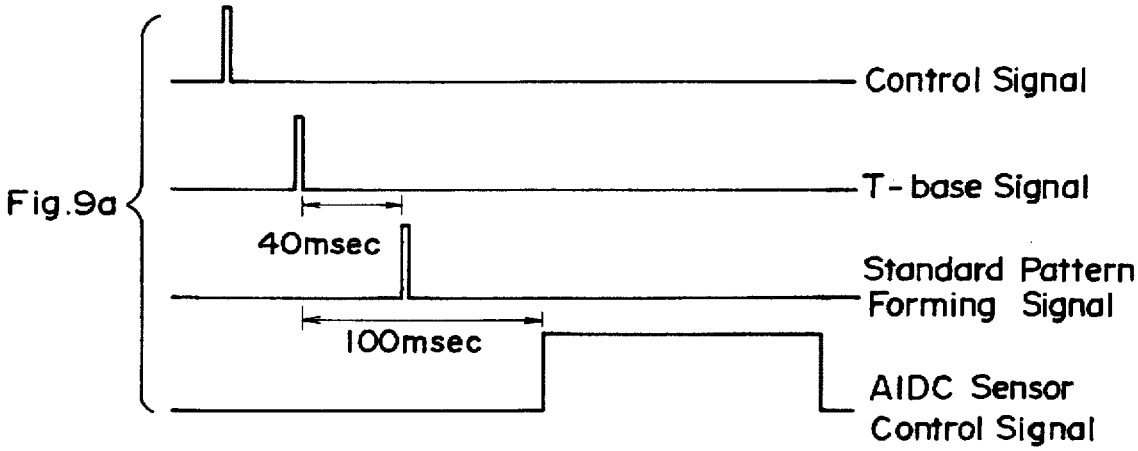
FIG. 9*a* illustrates the detection timing of the standard pattern via an AIDC sensor.
Figure 9B:
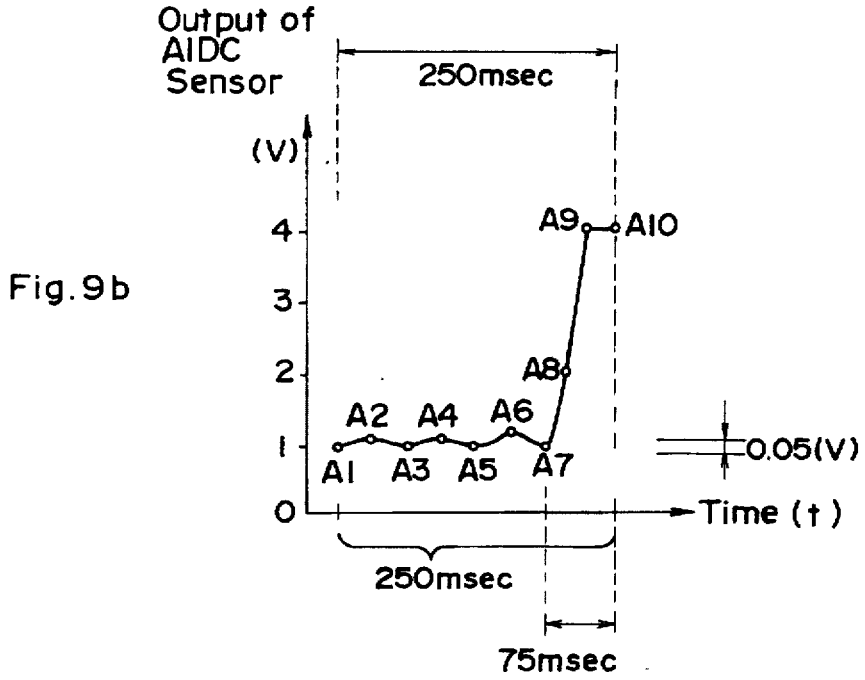
FIG. 9*b* illustrates the output of the AIDC sensor by said timing.

FIGS. 9a and 9b are graphs showing detection results when the operation timing of AIDC sensor 210 is delayed and continuous detection begins from the middle of the standard pattern regardless of the standard pattern having passed the sensor. As shown in FIG. 9a, printer control unit 201 starts the operation sequence to form a standard pattern on the surface of photosensitive drum 41 40 msec after the T-base signal is detected, and operates the AIDC sensor 210 100 msec after detection of the T-base signal to start the detection of the amount of adhered toner of the standard pattern. As shown in FIG. 9b, when the detection value (V) of the AIDC sensor 210 is continuously a negative value which exceeds the change in detection value of 0.5 (V), it can be determined that detection starts late. In this instance, printer control unit 201 hastens the operation timing of AIDC sensor 210 by only 75 msec.

Figure 10:
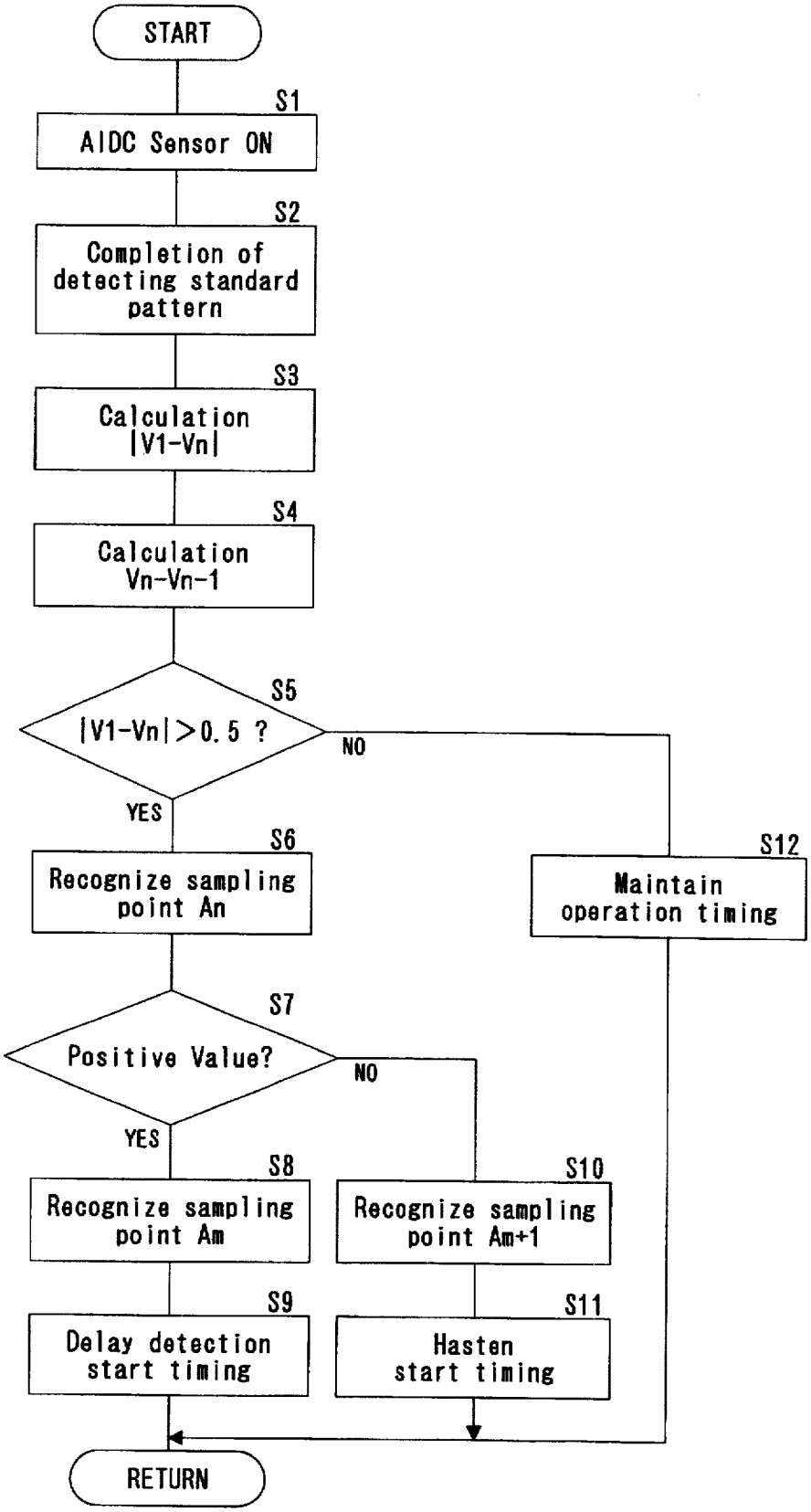
FIG. 10 is a flow chart of the detection timing correction process.

FIG. 10 is a flow chart of the processes executed by the printer control unit 201 to correct the operation timing of AIDC sensor 210 so as to accurately detect a standard pattern via AIDC sensor 210 after the T-base signal is detected.

First, AIDC sensor 210 is actuated to detect a standard pattern (step S1). The output (V) of the AIDC sensor 210 is checked at predetermined intervals, and after a predetermined time has elapsed, operation of AIDC sensor 210 is stopped and standard pattern detection ends (step S2). In the present embodiment, as previously described in conjunction with FIG. 7, the standard pattern detection time of AIDC sensor 210 is 250 msec. The change in detection values between the detection value $V_1$ (V) at the first sampling point $A_1$ and the detection values $V_n$ (V) at other sampling points an, i.e., $|V_1-V_2|$, $|V_1-V_3|$, . . . $|V_1-V_{nmax}|$ are determined (step S3). In this case n is a value 1, 2, . . . nmax. The value nmax is a value derived by dividing the detection time by the detection interval. In the present embodiment, the detection time is 250 msec, and the detection interval is 25 msec, such that the value of nmax is 10. Then, the difference $V_n-(V_n-1)$ (V) of detection values between adjacent sampling points is determined (step S4). The absolute value ($|V_1-V_n|$) of the change in detection values between adjacent sampling points obtained in step S3 are compared to a predetermined first reference value (=0.5) (step S5). The first reference value is a positive value determining whether or whether or not to correct the timing to start the next sampling. When the absolute values of the change in detection values of all sampling points is less than the first reference value (=0.5) (step S5: NO), it is determined that the AIDC sensor 210 is accurately detecting the standard pattern, and the operation timing of the AIDC sensor 210 after the detection of the T-base signal is maintained (step S12). On the other hand, when an absolute value of the change of detection values exceeds the first reference value (=0.5) (step S5: YES), the sampling point $A_n$ at which the first reference value is exceeded by the first absolute value of the change in detection value is recognized (step S6). When the value of $V_1-V_n$ at the recognized sampling point $A_n$ is a positive value (step S7: YES), at sampling points subsequent to the sampling point recognized in step S6, the sampling point $A_m$ (where $n \leqq m \leqq nmax$) at which the absolute value of the difference between detection values of adjacent sampling points (i.e., $|V_m-V_{m-1}|$) is less than a second reference value are recognized (step S8). This second reference value is set at a positive value which is unobtainable when the standard pattern is detected. In the present embodiment, the second reference value is set at 0.05 (V). The detection start timing of the AIDC sensor 210 is delayed only the time from sampling point $A_1$ to the sampling point $A_m$ obtained in step S8. (step S9).

When the value $V_1-V_n$ is negative at the sampling point $A_n$ which exceeds the first reference value (step S7: NO), the sampling point $A_{m+1}$ at which the value $V_m-V_{m+1}$ (V) is less than the second reference value is recognized as being before the sampling point $A_n$ recognized in step S6 (step S8). The detection start timing of the AIDC sensor 210 is hastened only the time from sampling point $A_{m+1}$, determined in step S8 to $A_{nmax}$ (step S11).

If the timing is corrected in either step S9 or step S11, or if the timing maintained in step S12 is again reached, the processes of steps S1 through S12 are executed.

(5) Modifications

Below is described another example of processing executed by the print control unit 201 to correct the operation timing of AIDC sensor 210 so as to accurately detect the standard pattern by AIDC sensor 210 after a T-base signal is detected. In this embodiment, when the absolute value of the change between a reference and a sampling point exceeds a first reference value, the operation timing of the AIDC sensor 210 is delayed only to the point which exceeds said first reference value.

Figure 11:
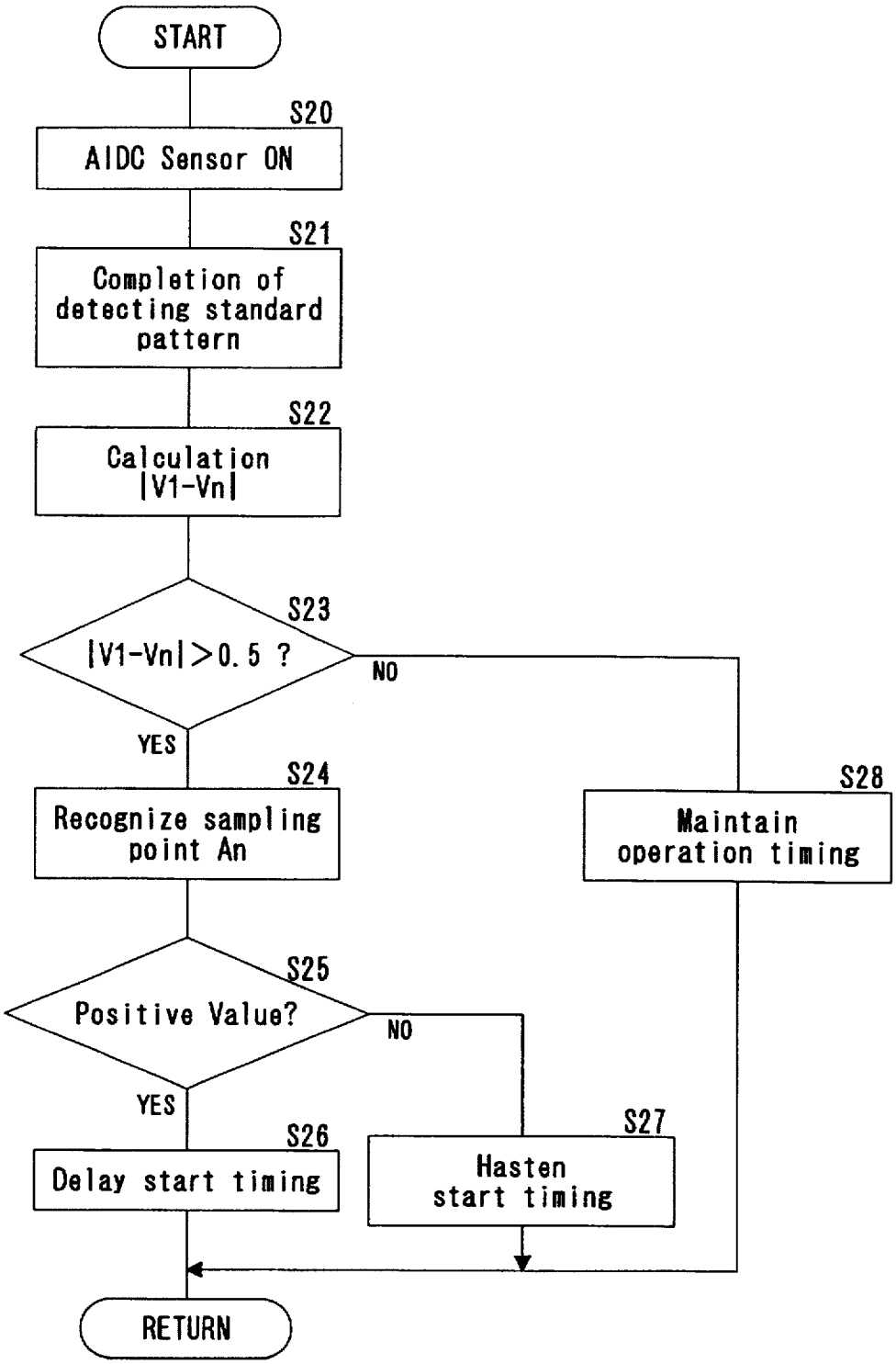
FIG. 11 is a flow chart of another detection timing correction process.

FIG. 11 shows a modification of the process sequence executed by printer control unit 201 shown in the flow chart of FIG. 10. The process sequence shown in the flow chart of FIG. 11 replaces the process sequence of FIG. 10 and is executed by print control unit 201.

First, AIDC sensor 210 is actuated to detect a standard pattern (step S20). The output (V) of the AIDC sensor 210 is checked at predetermined intervals, and after a predetermined time has elapsed, operation of AIDC sensor 210 is stopped and standard pattern detection ends (step S21). In the present embodiment, as previously described in conjunction with FIG. 7, the standard pattern detection time of AIDC sensor 210 is 250 msec. The change in detection values between the detection value $V_1$ (V) at the first sampling point $A_1$ and the detection values $V_n$ (V) at other sampling points $A_n$, i.e., $|V_1-V_2|$, $|V_1-V_3|$, . . . $|V_1-V_n|$ are determined (step S22). In this case n is a value 1, 2, . . . nmax. The value nmax is a value derived by dividing the detection time by the detection interval. In the present embodiment, the detection time is 250 msec, and the detection interval is 25 msec, such that the value of nmax is 10. The absolute value ($|V_1-V_n|$) of the change in obtained detection values is compared to a predetermined first reference value (=0.5) (step S23). The first reference value is a positive value determining whether or whether or not to correct the timing to start the next sampling. When the absolute values of the change in detection values of all sampling points are less than the first reference value (=0.5) (step S23: NO), it is determined that the AIDC sensor 210 is accurately detecting the standard pattern, and the operation timing of the AIDC sensor 210 after the detection of the T-base signal is maintained (step S28). On the other hand, when an absolute value of the change of detection values exceeds the first reference value (=0.5) (step S23: YES), the sampling point An at which the first reference value is initially exceeded by the absolute value of the difference between detection value $V_1$ at the first sampling point is recognized (step S24). When the value of $V_1-V_n$ at the recognized sampling point $A_n$ is a positive value (step S25: YES), the timing to switch ON the AIDC sensor 210 is delayed by a time only from sampling point $A_1$ to point $A_n$ (step S26). When the value of $V_1-V_n$ at the recognized sampling point An is a negative (step S25: NO), the operation timing of AIDC sensor 210 is hastened by a time only from sampling point $A_n$ to point $A_{max}$ (step S27). If the timing is corrected in either step S26 or step S27, or if the timing maintained in step S28 is again reached, the processes of steps S20 through S28 are executed.

Figure 12A:
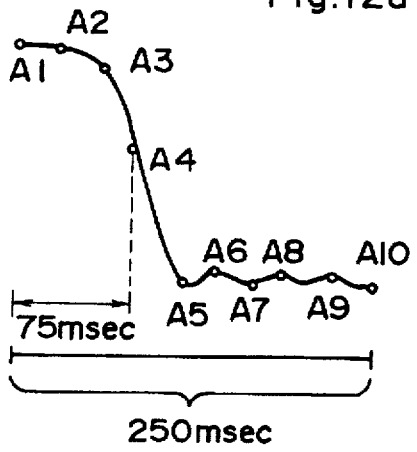
FIG. 12*a* shows the output of the AIDC sensor before timing correction at the beginning of detection by the AIDC sensor.
Figure 12B:
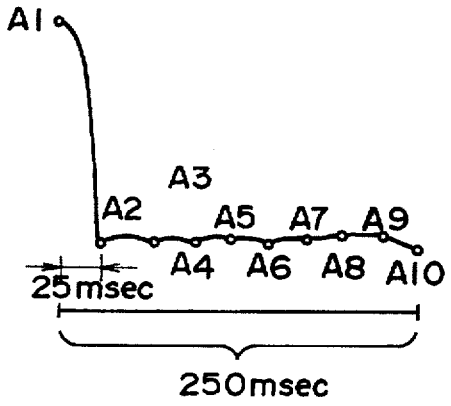
FIGS. 12*b* and 12*c* show the output of the AIDC sensor when the correction process is sequentially repeated.
Figure 12C:
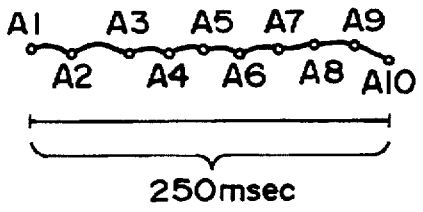

FIGS. 12*a*, 12*b*, 12*c* are graphs showing the output of AIDC sensor 210 at each detection time when the operation timing of AIDC sensor 210 has been corrected based on the flow chart. FIG. 12*a* is a graph showing the first output of AIDC sensor 210. When the absolute value of the difference of detection values at point $A_1$ exceeds the first reference value, the operation timing of AIDC sensor 210 is delayed from point $A_1$ to point $A_4$, i.e., 75 msec. In this case, the output of AIDC sensor 210 is shown in graph b. When the absolute value f the difference of detection values at point $A_2$ relative to point $A_1$ exceeds the first reference value, the operation timing of AIDC sensor 210 on the next cycle is delayed from point $A_1$ to point $A_2$, i.e., 25 msec. As a result, the standard pattern is accurately detected during the next detection by AIDC sensor 210.

Furthermore, image density control can be executed with excellent precision using similar controls for the detection of surface potential $V_O$ of photosensitive drum 41 via $V_O$ sensor 44.

As can be clearly understood from the preceding description, the image forming apparatus of the present invention corrects the detection timing based on the dispersion of detection values even when the detection timing of a standard pattern formed on a photosensitive member lags due to environmental disturbances and the like. Thus, the detection timing is optimized for the next detection cycle, and providing greater detection accuracy.

Although the above embodiments have been described in terms of the timing correction for detection of the amount of adhered toner of a standard toner image formed on the surface of a photosensitive member via the use of sensors, the present invention may be used to correct various types of detection timing including correcting the timing for detecting position of a standard toner image before development.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus which provides a sensor on the movement path of a movable photosensitive member to detect characteristics value of the photosensitive member, said image forming apparatus comprising:

a sampling means for sampling density values at a plurality of sampling points on a standard pattern image formed on said photosensitive member by operating said sensor with a timing at which said sensor confronts said standard pattern image;

a comparison means for mutually comparing a plurality of sampling values obtained by the sampling of said sampling means;

a determination means for determining whether or not the timing of said sampling means lags the standard pattern image based on the comparison result of said comparison means;

a correction means for correcting the timing by eliminating the timing lag when a timing lag is determined by said determination means, such that sampling of a subsequent sampling cycle is thereby conducted based on a corrected timing; and a controller which controls an image forming operation in accordance with the sampling values.

2. An image forming apparatus as claimed in claim 1 wherein said comparison means calculates the difference values between a sampling value at a first sampling points and each of the other sampling values.

3. An image forming apparatus as claimed in claim 2 wherein said determination means determines that the timing of said sampling means lags the standard pattern image when at least one of said calculated difference value exceeds the first reference value.

4. An image forming apparatus as claimed in claim 3 further comprising a second comparison means for comparing the sampling values at adjacent sampling points, wherein said correction means corrects the timing in accordance with said comparison results of said second comparison means.

5. An detecting apparatus which provides a sensor on the movement path of the detection object to detect characteristics value of the detection object, said detecting apparatus comprising:

a sampling means for sampling characteristics values at a plurality of sampling points on a detection object by operating said sensor with a timing at which said sensor confronts said detection object;

a comparison means for mutually comparing a plurality of sampling values obtained by the sampling of said sampling means;

a determination means for determining whether or not the timing of said sampling means lags the detection object based on the comparison result of said comparison means; and a correction means for correcting the timing by eliminating the timing lag when a timing lag is determined by said determination means, such that sampling of a subsequent sampling cycle is thereby conducted based on a corrected timing.

6. An detecting apparatus as claimed in claim 5 wherein said comparison means calculates the difference values between a sampling value at a first sampling points and each of the other sampling values.

7. An detecting apparatus as claimed in claim 6 wherein said determination means determines that the timing of said sampling means lags the detection object when at least one of said calculated difference value exceeds the first reference value.

8. An detecting apparatus as claimed in claim 7 further comprising a second comparison means for comparing the sampling values at adjacent sampling points, wherein said correction means corrects the timing in accordance with said comparison results of said second comparison means.

9. An image forming method used in an image forming apparatus which provides a sensor on the movement path of a movable photosensitive member to detect characteristics value of the photosensitive member, said image forming method comprising steps of:

sampling density values at a plurality of sampling points on a standard pattern image formed on said photosensitive member by operating said sensor with a timing at which said sensor confronts said standard pattern image;

mutually comparing a plurality of sampling values obtained in said sampling step;

determining whether or not the timing of said sampling means lags the standard pattern image based on the comparison result of said comparing step;

correcting the timing by eliminating the timing lag when a timing lag is determined in said determining step, such that sampling of a subsequent sampling cycle is thereby conducted based on a corrected timing; and controlling an image forming operation in accordance with the sampling values.

10. An image forming method as claimed in claim 9 wherein the difference values between a sampling value at a first sampling point and each of the other sampling values are calculated in said comparing step.

11. An image forming method as claimed in claim 10 wherein the timing lag is determined in said determining step when at least one of said calculated difference value exceeds the first reference value.

12. An image forming method as claimed in claim 11 further comprising a second comparing step of comparing the sampling values at adjacent sampling points, wherein the timing is corrected in accordance with said comparison results of said second comparing step.

* * * * *